US007301145B2

(12) United States Patent
Holle et al.

(10) Patent No.: US 7,301,145 B2
(45) Date of Patent: Nov. 27, 2007

(54) DAUGHTER ION SPECTRA WITH TIME-OF-FLIGHT MASS SPECTROMETERS

(75) Inventors: Armin Holle, Oyten (DE); Michael Schubert, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 120 days.

(21) Appl. No.: 11/229,047

(22) Filed: Sep. 16, 2005

(65) Prior Publication Data

US 2006/0108521 A1 May 25, 2006

(30) Foreign Application Priority Data

Sep. 20, 2004 (DE) ..... 10 2004 045 534

(51) Int. Cl.
*H01J 49/44* (2006.01)

(52) U.S. Cl. ..... 250/287

(58) Field of Classification Search ..... 250/282, 250/287

See application file for complete search history.

(56) References Cited

U.S. PATENT DOCUMENTS

| | | | |
|---|---|---|---|
| 6,285,027 | B1 | 9/2001 | Chernushevich et al. |
| 6,348,688 | B1 | 2/2002 | Vestal |
| 6,441,369 | B1 | 8/2002 | Vestal et al. |
| 6,534,764 | B1 * | 3/2003 | Verentchikov et al. ..... 250/287 |
| 2002/0117616 | A1 | 8/2002 | Vestal |
| 2003/0042412 | A1 | 3/2003 | Park |

FOREIGN PATENT DOCUMENTS

| | | | |
|---|---|---|---|
| DE | 198 56 014 | A1 | 4/1998 |
| DE | 198 56 014 | C2 | 7/2000 |
| EP | 0 898 297 | A2 | 2/1999 |
| EP | 1 220 290 | A2 | 7/2002 |
| WO | WO 02/48699 | A2 | 6/2002 |
| WO | WO 03/103007 | A1 | 12/2003 |
| WO | WO 2004/083805 | A2 | 9/2004 |

* cited by examiner

*Primary Examiner*—David A. Vanore
(74) *Attorney, Agent, or Firm*—The Law Offices of Paul E. Kudirka

(57) ABSTRACT

The invention relates to methods and devices for measuring daughter ion spectra (also called fragment ion spectra or MS/MS spectra) in time-of-flight mass spectrometers with orthogonal injection of the ions. The invention filters the parent ions selected to be fragmented by a mass filter before they are injected into the time-of-flight mass spectrometer, fragments the selected ions in a first stage of the time-of-flight mass spectrometer within a collision cell filled with collision gas at collision energies between one and five kiloelectron-volts, further accelerates the fragment ions and measures the fragment ions in a second stage of the time-of-flight mass spectrometer.

6 Claims, 1 Drawing Sheet

DAUGHTER ION SPECTRA WITH TIME-OF-FLIGHT MASS SPECTROMETERS

FIELD OF THE INVENTION

The invention relates to methods and devices for measuring daughter ion spectra (also called fragment ion spectra or MS/MS spectra) in time-of-flight mass spectrometers with orthogonal injection of the ions.

BACKGROUND OF THE INVENTION

Fragment ion spectra supply information about the structure of the fragmented ions; for peptides they provide considerable information about the sequence of the amino acids. The acquisition of daughter or fragment ion spectra basically requires (a) a station for selecting the ions to be fragmented (the "parent ions"), (b) a station for fragmenting the parent ions, and (c) a station for analyzing the fragment ions. For selecting the parent ions, a filtering mass spectrometer is required; for the analysis, a mass spectrometer which acquires the daughter ion spectrum. Therefore the term "tandem mass spectrometry" is used.

There are two fundamentally different methods for the acquisition of daughter ion spectra in time-of-flight mass spectrometers:

The first method, which, in commercial embodiments, always involves ionization of the analyte molecules by matrix-assisted laser desorption (MALDI), uses so-called TOF/TOF mass spectrometers. TOF/TOF mass spectrometers are two-stage time-of-flight mass spectrometers, in whose first stage the ions are both selected and fragmented, and in whose second stage the fragment ions are measured separately as daughter ion spectra after a further acceleration phase. The ions can be fragmented by laser-induced metastable decomposition (LID, also termed post source decay or PSD) in the flight region of the first stage, or by collision-induced decomposition (CID) in a collision cell at collision energies of around two kiloelectron-volts. These methods and the corresponding instruments are described in DE 198 56 014 C2 (U.S. Pat. No. 6,300,627 B1, C. Köster, A. Holle, J. Franzen) and in U.S. Pat. No. 6,348,688 B1 (M. L. Vestal, S. C. Gabeler), U.S. Pat. No. 6,441,369 B1 (M. L. Vestal, S. C. Gabeler), U.S. Pat. No. 6,534,764 B1 (A. N. Verentchov, M. L. Vestal), US2002/0,117,616 A1 (M. L. Vestal). The first stage of the time-of-flight mass spectrometer demonstrates only moderate selectivity because the fragmentation always causes a slight smearing of the flight times of the ions.

The second method utilizes time-of-flight mass spectrometers with orthogonal injection (OTOF) of a continuous current of ions into an ion pulser, in which the ions experience a frequently-repeated sharply-pulsed orthogonal deflection into the flight path of the time-of-flight mass spectrometer. For tandem mass spectrometry, the parent ions are selected in suitable mass filters and fragmented in collision cells before being injected into the time-of-flight mass spectrometer. As a rule, they are selected in an RF quadrupole mass filter (Q), resulting in good selectivity, while fragmentation takes place in a further RF quadrupole collision cell. These instruments are abbreviated to QqOTOF, the lower case q indicating that what we have here is a collision cell and not a mass separating function. Methods and instruments of this type are described in detail in the patent specifications and patent publications EP 0 898 297 A2 (U.S. Pat. No. 6,107,623, R. H. Bateman, J. B. Hoyes), EP 1 220 290 A2 (R. H. Bateman, J. B. Hoyes), U.S. Pat. No. 6,285,027 B1 (I. Chernushevich, B. Thomson), WO 02/48 699 A2 (B. Thomson). The fragmentation occurs in the collision cells as a result of a large number of collisions at low collision energy, energy being absorbed by the complex internal oscillation system of the molecule until a statistical accumulation of the energy at a weak bond leads to a fragmentation of the molecule.

The fragmentation in a quadrupole collision cell, which is used in the second method using an OTOF, functions extremely well for doubly-charged ions, as are obtained in electrospray ion sources, for example. For matrix-assisted laser desorption (MALDI) producing practically only singly-charged ions, in contrast, the fragmentation in the collision cell is poor, since here only the bonds of the lowest possible binding energy break. If other bonds have a binding energy only higher by a few tenths of an electron-volt, so few of them break that the resulting fragment ions are no longer visible in the measured spectrum. The second method utilizing the OTOF, which has great advantages with respect to mass precision and selectivity, cannot therefore be used for ions from the MALDI process.

The high-energy collision process of the first method, on the other hand, achieves much better fragmentation of the singly-charged ions from the MALDI process. The fragmentation here occurs spontaneously at the first collision because sufficient energy is transferred. For peptides, the splitting take place statistically in the vicinity of the collision location, affecting all bonds between the amino acids. It is not only the bonds along the chain of the amino acids which are split, however. Side groups also split off, with a subsequent fragmentation of the chain by rearrangement processes.

SUMMARY OF THE INVENTION

The invention provides devices and methods which select the parent ions before they are orthogonally injected into a time-of-flight mass spectrometer, but fragment them in a collision cell in a first stage of the time-of-flight mass spectrometer, after which the daughter ions are further accelerated and measured in the second stage. This makes it possible to use high-energy collisions with around one to five kiloelectron-volts for the fragmentation, so that singly-charged ions, for example from MALDI processes, can also be fragmented.

The simplest way of selecting the parent ions here is with a quadrupole mass filter, as is also usual for the second method described above. The fragmentation does not occur in a quadrupole collision cell, however, but in a first stage of the time-of-flight mass spectrometer. This first stage of the time-of-flight mass spectrometer is not used for the selection, however, since its selectivity is too poor. The generic abbreviation "Q-tof-TOF" is thus an obvious choice, indicating that mass selection is not the purpose of the first stage of the time-of-flight mass spectrometer.

The advantage of this type of method lies in a combination of good selectivity and a collision-induced decomposition which produces a high number of fragments for singly-charged ions as well. The selectivity is around one mass unit for ions with a mass of 1,000 atomic mass units.

The parent ions can be accelerated in the pulser with a voltage of two kilovolts, for example, and fragmented in a collision cell which is at ground potential. The fragment ions can then be further accelerated with 18 kilovolts in an acceleration stage which is constantly switched on and be measured as a daughter ion spectrum after passing the second flight region. This requires no further rapid and accurately-timed voltage switching apart from the outputsing in the pulser, but it does require ion detection at a high acceleration potential. The resolution in the daughter ion spectrum here is only moderately good, since the slight smearing of the kinetic energies of the fragment ions by the collision processes cannot be ironed out even by using an energy-focusing reflector.

The fragment ions can also be introduced voltageless into a "lift" region and then raised to a potential which is quickly switched on, so that they are postaccelerated in the subsequent accelerating field, as similarly described in DE 198 56 014 C2 (U.S. Pat. No. 6,300,627 B1). A small potential difference in the "lift" region makes it possible to largely compensate for the energy smearing of the collision processes and hence to achieve a better mass resolving power of around R=5000 in the daughter ion spectrum. This setup has the further advantage that the flight regions can be kept at ground potential in both the first stage and in the second stage, and the ion detection can also be carried out at ground potential.

BRIEF DESCRIPTION OF THE DRAWING

The above and further advantages of the invention may be better understood by referring to the following description in conjunction with the accompanying drawing in which.

DETAILED DESCRIPTION

Figure 1:
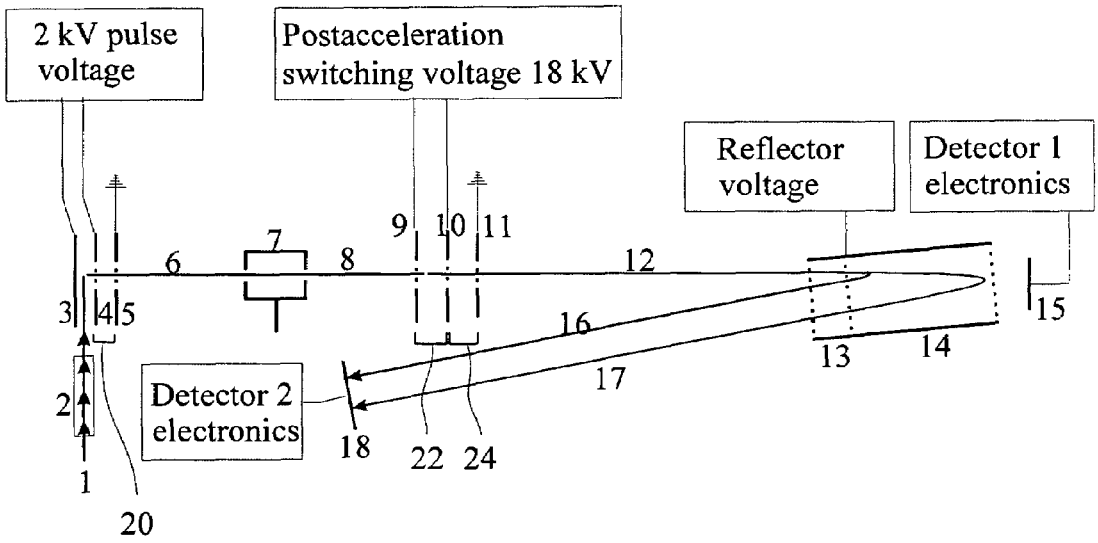
FIG. 1 shows a schematic representation of a particularly favorable embodiment of a reflector time-of-flight mass spectrometer according to this invention, in which the parent ions are selected from an ion beam (1) in a mass filter (2) before being injected into the pulser (3,4) of the time-of-flight mass spectrometer. The ions which emerge from the pulser (3,4) are accelerated in the acceleration region 20 between the grid diaphragms (4) and (5) with only 2 kV and fragmented in the collision cell (7). After all the fragment ions have entered the "lift" region 22 between the grid diaphragms (9) and (10), they are raised to a potential of 18 kilovolts and post-accelerated in the acceleration region 24 between the grid diaphragms (10) and (11) so that they can be detected, after being reflected in the ion reflector (13, 14), with good mass resolution by the ion detector (18).

A preferred embodiment of a method and a device according to this invention is shown in FIG. 1 as a schematic diagram. The ions are shaped into an ion beam (1) in an ion source (not shown). The parent ions, whose structure is to be determined, are selected in a mass filter (2), preferably an RF quadrupole mass filter, whereby all other ions are eliminated. The ion beam of parent ions is then injected, orthogonally to the flight path, into the time-of-flight mass spectrometer, more precise into the space between the two diaphragms (3) and (4) of the pulser. The injection is carried out at a very low energy of around 20 electron-volts. The slow ions fill the space between the diaphragms (3) and (4) in a time of around 10 to 50 microseconds, depending on the mass of the parent ions. When the space has just been filled, both diaphragms (3) and (4) are raised to a potential difference of around two kilovolts, the repelling diaphragm (3) having a somewhat higher potential, the attractive diaphragm (4) a somewhat lower potential. The ions therefore leave this space and are further accelerated in the space between the diaphragms (4) and (5) to roughly two kilovolts. The ion beam (6) of the parent ions has a flat, band-shaped structure because a whole section of the primary ion beam (1) is pulsed out.

The schematic representation of FIG. 1 does not show the band-shaped structure of the deflected ion beam from the pulser. The shown side view of the beam is only correct for an injection of the ion beam (1) into the pulser (3, 4) perpendicular to the plane of the drawing, different from the schematic view of FIG. 1.

The beam (6) of parent ions, which comprises a single beam of ions with the same mass and the same velocity, is now injected into the collision cell (7), which is filled with a collision gas. The size of the collision cell and the pressure of the collision gas are selected so that on statistical average, approx. one collision per parent ion occurs. This causes unfragmented parent ions to be left over, but not too many multiply fragmented ions are created. The multiply fragmented ions comprise both fragments which contain one end of the original molecule and also so-called "inner fragments", not containing one end of the original molecule, which makes it difficult to interpret the daughter ion mass spectrum.

The beam (8) of fragment ions, which now contains fragment ions with different masses but still practically the same velocities, apart from very slight energy changes as a result of the collisions, is now guided into the lift between the two diaphragms (9) and (10). When all fragment ions have entered, the potential of this lift is raised by around 18 kilovolts. On emerging, the ions thus encounter an acceleration region between the diaphragms (10) and (11), in which they are postaccelerated by a further 18 kilovolts.

The postaccelerated fragment ions now no longer possess the same velocity: the light fragment ions fly quickly, the heavy ones slowly. After a further flight region they can thus be detected time-resolved. They can be measured either in the detector (15) in a linear flight mode when the voltages at the reflector (13, 14) switched off, or in a detector (18), when the reflector (13, 14) switched on, in a reflection mode. The linear mode does not have such a high resolution as the reflecting mode because the reflector has an additional energy-focusing effect.

The slight energy losses of the fragment ions as a result of the collisions and the decompositions cannot be compensated and equalized by the reflector alone, however. But compensation is largely successful if there is an additional acceleration of slower ions of the same mass in the "lift" region between the diaphragms (9) and (10). This requires that the two diaphragms be raised to slightly different potentials. It is then possible to achieve a mass resolving power of $m/\Delta m=R=5000$, where m is the mass of the ions and $\Delta m$ the width of the mass signals, both measured in the same type of mass units.

Furthermore, the primary spectra of the unfragmented and unselected ions of the ion beam (1) can be measured by scanning the RF quadrupole mass filter (2) if the ion beam impinges on a detector (not shown in FIG. 1) after passing through the unpulsed pulser (3, 4). They can also be measured in the time-of-flight mass spectrometer by switching off the filtering effect of the mass filter (2), by repeated pulsing with the collision cell and the postacceleration region switched off.

The time-of-flight mass spectrometer in another embodiment can also be operated in such a way that, by raising the potential of the flight (12), a continuously applied, i.e. non-switched, postacceleration voltage is used. The reflector and the ion detector (18) must then also be at a high potential. A further embodiment consists in also allowing most of the acceleration of the pulser between the diaphragms (4) and (5) to be constantly applied by means of a potential across the diaphragm (5) and by connecting only small voltage differences across the diaphragms (3) and (4). The potential of the flight region around the beam (6) and (8) and across the collision cell (7) must then also lie at the voltage of the diaphragm (5).

The reflector (13, 14) can be equipped with grids or it can also be operated without. By using a gridless reflector which also has a space-focusing component in the input region, both the light ions and the heavy ones can be guided together onto the small-area second detector more effectively than is shown in FIG. 1 using a reflector with a grid.

Since the light fragment ions do not have much kinetic energy after fragmentation, their detection in the ion detector with this post-acceleration is much better than it is in the previous mode of operation without post-acceleration. Ions with an energy of only 200 electron-volts, as remain after the generation of light ions by fragmentation, are usually not detected at all by a multiplier.

The lift cell (and the collision cell as well) can also be designed to fold out. This makes it possible to remove the lift cell, which after all carries a number of grids, for the purpose of carrying out a highly sensitive measurement of the original mixed spectra from the ion beam.

It is, of course, possible to equip completely different embodiments of time-of-flight mass spectrometers with a selection unit according to the invention upstream of the ion injection and a collision cell in the first flight region, for example time-of-flight spectrometers with more than one reflector. With knowledge of this invention, anyone skilled in the art of mass spectrometric analysis will be able to produce such fittings and equipment.

What is claimed is:

1. A mass spectrometer for the acquisition of fragment ion spectra, comprising a mass filter and a time-of-flight mass spectrometer with orthogonal ion injection, wherein a) the mass filter for selecting parent ions is located upstream of the orthogonal injection of the parent ions into the time-of-flight mass spectrometer, b) the time-of-flight mass spectrometer contains a collision cell for fragmenting the parent ions, the collision cell being positioned in a first stage of the time-of-flight mass spectrometer after the orthogonal ion injection, and c) the time-of-flight mass spectrometer contains a device for further accelerating the fragmented ions, the device being positioned in a second stage of the time-of-flight mass spectrometer after the collision cell.

2. The mass spectrometer according to claim 1, wherein the mass filter comprises an RF quadrupole mass filter.

3. The mass spectrometer according to claim 1, wherein the device for further accelerating the fragmented ions incorporates a "lift" region and an acceleration region, and wherein a power supply for further accelerating the fragmented ions supplies voltages which can be rapidly switched.

4. A mass spectrometer according to claim 3, wherein all regions in the mass spectrometer in which ions move apart from the "lift" region and the acceleration region are at ground potential.

5. A method for the acquisition of daughter ion spectra, wherein a) parent ions are selected by a mass filter, b) the parent ions are injected orthogonally into a time-of-flight mass spectrometer, c) the parent ions are fragmented into daughter ions in a collision cell in a first stage of the time-of-flight mass spectrometer, d) the daughter ions are further accelerated and measured in a second stage of the time-of-flight mass spectrometer.

6. The method according to claim 5, wherein the parent ions are injected into the collision cell for the fragmentation with kinetic energies of between one and five kiloelectron-volts.

* * * * *